United States Patent [19]

Shaffer et al.

[11] Patent Number: 5,057,147

[45] Date of Patent: Oct. 15, 1991

[54] METHOD FOR PREPARATION OF WC-NI GRADE POWDER

[75] Inventors: Mary E. Shaffer, Towanda; Edward R. Kimmel, Sayre, both of Pa.

[73] Assignee: GTE Products Corporation, Stamford, Conn.

[21] Appl. No.: 538,630

[22] Filed: Jun. 15, 1990

[51] Int. Cl.[5] ..... C22C 29/00

[52] U.S. Cl. ..... 75/252; 75/236; 419/18; 420/431; 428/627

[58] Field of Search ..... 75/252, 236; 420/431; 428/627; 419/18

[56] References Cited

U.S. PATENT DOCUMENTS

| | | | |
|---|---|---|---|
| 1,950,356 | 3/1934 | De Bats | 420/431 |
| 3,698,055 | 10/1972 | Holtz, Jr. et al. | 75/252 |
| 4,101,318 | 7/1978 | Rudy | 428/627 |
| 4,374,900 | 2/1983 | Hara et al. | 428/627 |
| 4,414,029 | 11/1983 | Newman et al. | 75/252 |
| 4,456,484 | 6/1984 | Benzamin et al. | 75/252 |

*Primary Examiner*—Upendra Roy
*Attorney, Agent, or Firm*—Elizabeth A. Levy

[57] ABSTRACT

A method is disclosed for producing tungsten carbide-nickel powder which comprises forming a powder mixture consisting essentially of in percent by weight of about 0.1 to about 1.0 dimolybdenum carbide, about 1 to about 4 tungsten metal powder, about 80 to about 98% tungsten carbide and about 2 to about 20 nickel, wherein a sintered article produced from the powder has a relatively uniform microstructure.

3 Claims, 2 Drawing Sheets

METHOD FOR PREPARATION OF WC-NI GRADE POWDER

BACKGROUND OF THE INVENTION

This invention relates to a method for producing a tungsten carbide-nickel grade powder by use of dimolybdenum carbide and tungsten metal powder. The dimolybdenum carbide and tungsten metal powder are used to control the carbon content in the grade powder product. The advantage of using dimolybdenum carbide is that there is more latitude in choosing the lots of tungsten carbide starting material, in grain growth inhibition and a more uniform microstructure in the sintered grade powder product.

Tungsten carbide containing nickel, or more commonly called nickel grade powder is used in the canning industry where a non-magnetic carbide is needed that will not be magnetic when cutting cans. It is used also to make oil seal rings where corrosion must be kept to a minimum. Up to this time this powder has been made using sub-stoichiometric tungsten carbide and nickel metal powder. Stable tungsten carbide has a carbon content of about 6.13% by weight. The sub-stoichiometric tungsten carbide, that is, tungsten carbide having a lower carbon content than the stoichiometric species is necessary to avoid carbon porosity. In order to provide sub-stoichiometric tungsten carbide, either a special low carbon tungsten carbide has to be made or large amounts of tungsten metal powder (WMP) has to be added to a normal (stoichiometric) tungsten carbide to reduce carbon levels. Large quantities of WMP degrade the microstructure of the material and can cause porosity and coarse tungsten carbide clusters and can alter the density of the material.

Therefore a method to produce tungsten carbide-nickel grade powder without the need for sub-stoichiometric tungsten carbide or large amounts of tungsten powder without sacrificing the quality of sintered products made from the powder especially as far as grain growth, microstructure and density, would be very desirable.

SUMMARY OF THE INVENTION

In accordance with one aspect of the invention, there is provided a method for producing tungsten carbide-nickel powder which comprises forming a powder mixture consisting essentially of in percent by weight of about 0.1 to about 1.0 dimolybdenum carbide, about 1 to about 4 tungsten metal powder, about 80 to about 98% tungsten carbide and about 2 to about 20 nickel, wherein a sintered article produced from the powder has a relatively uniform microstructure.

DETAILED DESCRIPTION OF THE INVENTION

Figure 1:
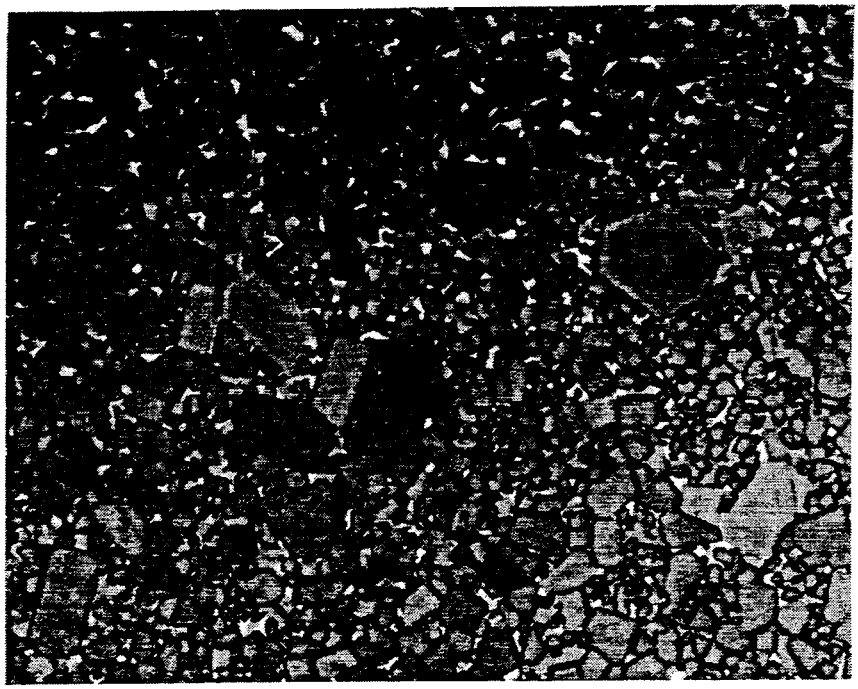
FIG. 1 is a photomicrograph taken 1500× magnification showing the grain growth of a sintered article or part in which no dimolybdenum carbide is used to make the grade powder.

For a better understanding of the present invention, together with other and further objects, advantages and capabilities thereof, reference is made to the following disclosure and appended claims in connection with the above described figures and description of some of the aspects of the invention.

The present invention provides a method to produce tungsten carbide containing nickel in which the starting tungsten carbide is mixed with dimolybdenum carbide, tungsten powder, and nickel. When dimolybdenum carbide is used, the starting tungsten carbide does not have to be sub-stoichiometric (that is typically about 5.9% by weight carbon as compared with about 6.13% by weight for stoichiometric tungsten carbide) and less tungsten metal powder has to be used than if dimolybdenum carbide is not used as has been the practice before the present invention, the disadvantages of tungsten powder having been discussed earlier. Dimolybdenum carbide is the most stable form of the molybdenum carbide species. It is converted to molybdenum carbide during the subsequent sintering step. The extra molybdenum in the dimolybdenum carbide reacts with some of the carbon in the tungsten carbide. Molybdenum carbide can form either dimolybdenum carbide or molybdenum carbide depending on the amount of excess carbon that is present. The present invention takes advantage of this carbon equalizing potential of molybdenum which allows nickel to be stable within a wider range of carbon levels. Because of the grain growth inhibiting effect of molybdenum, the microstructure is much more uniform with dimolybdenum carbide when compared with the sub-stoichiometric tungsten carbide or with use of tungsten metal powder.

The procedure according to the present invention for producing the tungsten carbide-nickel powder is as follows. A powder mixture is formed consisting essentially of in percent by weight of about 0.1 to about 1.0 dimolybdenum carbide, and most typically about 0.2 to about 0.8 dimolybdenum carbide, about 1 to 4 tungsten metal powder, about 80 to 98 tungsten carbide, and about 2 to 20 nickel powder and most typically about 6 to 10 nickel powder. The amounts of the mixture components depend on the desired composition in the product powder. The typical average particle sizes of the mixture components are about 1 to 5 micrometers for the dimolybdenum carbide, about 1 to 2 micrometers for the tungsten metal powder, about 1 to 5 for the tungsten carbide, and about 1 to 5 for the nickel powder. The mixture is formed by standard dry blending techniques.

The mixture can be used in any application requiring WC-Ni grade powder. Some preferred applications are described below, although it is to be understood that the invention is not limited to these applications.

Prior to formation of the green article, the mixture can be subjected to additional operations if necessary which are known in the art for making grade powders. For example, the mixture can be wet milled usually by ball milling or attritor milling with a milling fluid which can be water or a solvent such as water, alcohol, acetone, heptane, etc. to insure that the components are intimatey mixed. A binder can be added if necessary as a pressing aid. The binder is usually a wax such as paraffin or polyethylene glycol such as supplied by Union Carbide under the name of Carbowax. The binder components are typically added to the powder mixture after the mixture but can be added before the milling in which case they are milled with the powder mixture.

The milling fluid is removed by drying.

If a binder is added, the powder mixture and binder can be agglomerated such as by conventional spray drying techniques.

The resulting powder mixture (and binder, if a binder has been added) is then processed to form a green article by known methods as by pressing, for example, mechanical, hydraulic, or isostatic pressing.

The article can be any convenient shape and size depending on the application. Some typical applications for articles made by the above described methods are as seal rings or cutting tool inserts.

If a binder is present, it can be removed by standard dewaxing techniques. The binder removal step can be combined with the subsequent sintering step, or could be a separate dewaxing step depending on the application.

The resulting green article is then sintered typically in vacuum to produce the tungsten carbide-nickel grade powder product. The sintering temperature is normally about 1350° C. to about 1500° C. for about 30 minutes to about 1 hour or longer depending on the size of the article or part and the furnace conditions. For about 6% by weight nickel, the sintering temperature is typically about 1435° C. to about 1460° C.

The advantages of using dimolybdenum carbide in the present invention are: (1) a special sub-stoichiometric tungsten carbide does not have to be made for carbon control in the product grade powder. Therefore normal tungsten carbide lots can be used and therefore a more versatile inventory of starting tungsten carbide is available; (2) the density using a combination of tungsten metal powder and dimolybdenum carbide is not adversely affected, but remains satisfactory; and (3) grain growth inhibition is an added benefit when dimolybdenum carbide is used. Microstructures of the formed and sintered articles made from the grade powder of the present invention are more uniform than those from powders made without dimolybdenum carbide.

Figure 2:
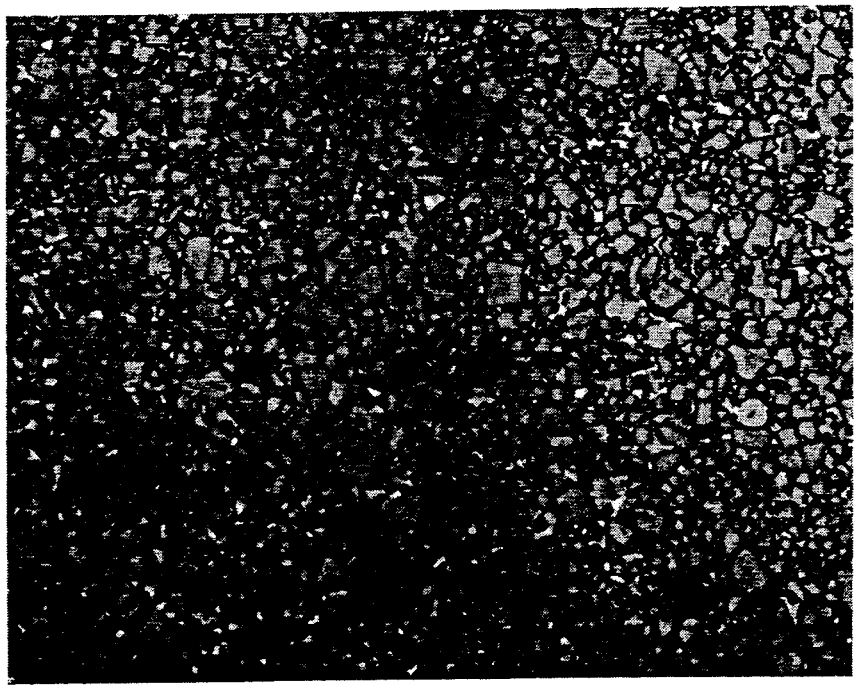
FIG. 2 is a photomicrograph taken 1500× magnification showing the grain growth in a sintered article in which dimolybdenum carbide is used at a level of about 0.2% by weight.
Figure 3:
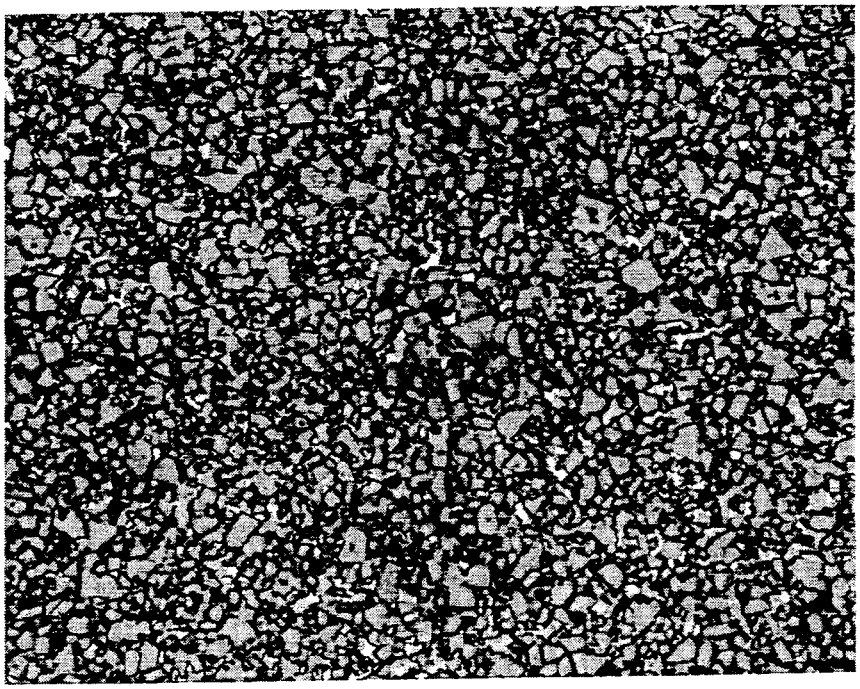
FIG. 3 is a photomicrograph taken 1500× magnification showing the grain growth in a sintered article in which dimolybdenum carbide is used at a level of about 0.8% by weight.

FIG. 1 is a photomicrograph taken 1500× magnification of a sintered article or part in which no dimolybdenum carbide is used to make the grade powder. FIG. 2 shows the grain growth in an article in which dimolybdenum carbide is used at a level of about 0.2% by weight at 1500× magnification. FIG. 3 shows the grain growth of an article in which dimolybdenum carbide is used at a level of about 0.8% by weight at 1500× magnification. It can be seen that the more dimolybdenum carbide that is present, the more uniform and consistent is the grain size and undesirable grain growth is at a minimum.

To more fully illustrate this invention, the following nonlimiting example is presented.

EXAMPLE

The following components are blended together: (1) about 6.0% by weight nickel powder having a particle size of about 1 to 5 micrometers in diameter, (2) about 92.4% by weight tungsten carbide having a carbon content of about 6.13% by weight, (3) about 1.2% by weight tungsten powder having a particle size of about 1 to 2 micrometers in diameter, (added to adjust the carbon content of the tungsten carbide to about 6.05% by weight), and (4) about 0.4% by weight $Mo_2C$ having a particle size of about 1 to 5 micrometers in diameter. The components are attritor milled with a binder which is paraffin in water and spray dried to agglomerate the powder. The powder is pressed at about 12 tons per square inch and vacuum dewaxed and vacuum sintered at about 1460° C. in one cycle. The density of sintered parts made from this nickel grade powder (WC-6% by weight Ni) which is blended with dimolybdenum carbide is given below along with the density of those articles made from powders in which no dimolybdenum carbide is used. The density of articles made from mixtures in which dimolybdenum carbide is used is more capable of reaching full density than those in which large amounts of tungsten must be used. The desired density for this type of powder is about 14.90 to about 15.00 g/cc. The articles are vacuum dewaxed and vacuum sintered.

| # | Description | Actual Density g/cc | Theoretical Density g/cc |
|---|---|---|---|
| 1 | WC-6.05% total C no $Mo_2C$, only W | 14.84 | 15.00 |
| 2 | WC-6.05% total C 0.4% $Mo_2C$, W | 14.96 | 14.96 |

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for controlling the carbon content in tungsten carbide-nickel powder, said method comprising forming a powder mixture consisting essentially of, in percent by weight, about 0.1 to about 1.0 dimolybdenum carbide, about 1 to about 4 tungsten metal powder, about 80 to about 98 tungsten carbide and about 2 to about 20 nickel, and vacuum sintering a compacted article at 1460° C. having a relatively uniform microstructure and absence of exaggerated grain growth.

2. A method of claim 1 wherein said powder mixture contains about 6% to about 10% by weight nickel.

3. A method of claim 1 wherein said powder mixture contains about 0.2% to about 0.8% by weight dimolybdenum carbide.

* * * * *